United States Patent [19]

Rimmel

[11] 4,061,485

[45] Dec. 6, 1977

[54] METHOD OF AND APPARATUS FOR CONTROLLING THE DISTRIBUTION OF FIBERS ON A RECEIVING SURFACE

[75] Inventor: Carl F. Rimmel, Newark, Ohio

[73] Assignee: Owens-Corning Fiberglas Corporation, Toledo, Ohio

[21] Appl. No.: 736,013

[22] Filed: Oct. 27, 1976

Related U.S. Application Data

[63] Continuation of Ser. No. 582,464. May 30, 1975, abandoned.

[51] Int. Cl.[2] ..... C03B 37/04

[52] U.S. Cl. ..... 65/4 R; 65/6; 65/9; 65/14; 65/161; 156/62.4; 264/8; 264/12; 425/66

[58] Field of Search ..... 65/56, 4 R, 9, 11 R, 65/14, 16, 29, 161; 264/8, 12, 14; 425/66; 156/62.4, 62.2

[56] References Cited

U.S. PATENT DOCUMENTS

| | | | |
|---|---|---|---|
| 2,653,416 | 9/1953 | Slayter | 65/9 X |
| 2,863,493 | 12/1958 | Snow et al. | 156/62.4 |
| 2,897,874 | 8/1959 | Stalego et al. | 65/9 X |
| 3,265,481 | 8/1966 | Smock et al. | 65/9 |
| 3,599,848 | 8/1971 | Thumm et al. | 65/2 X |

*Primary Examiner*—Robert L. Lindsay, Jr.
*Attorney, Agent, or Firm*—John W. Overman; Charles F. Schroeder

[57] ABSTRACT

A method and system for controlling the deposition of fibers issuing from a fiberizing unit in a veil which displaces portions of the veil with fluid streams, e.g., air blasts. A moving continuous collector screen receives the veil to form a mat of fibers. Speed of the collector is coordinated with the rate of deposition in determining the amount of fiber deposited per unit length of product. Air streams directed transversely of the direction of motion of the collector displace portions of the veil toward the collector edges. Absence of the air blast permits deposition of the veil to be concentrated on the collector center region. Application of gas streams in pulses cause splitting of the veil into sections which are displaced laterally across the collector with pulse frequency generally being increased with collector speed, and center to edge weight distribution of product being coordinated with the pulse interval length and the interval between pulses. A pulse generator having independent frequency and duty cycle controls to control air valves in the conduit to nozzles supplying the air streams enables a machine attendant to control and adjust veil distribution on the collector. Electrical controls for the air valves are disclosed.

21 Claims, 4 Drawing Figures

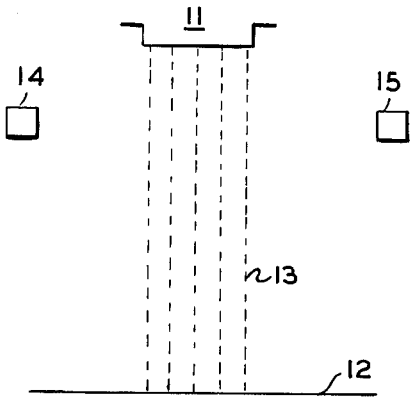
FIG. 1
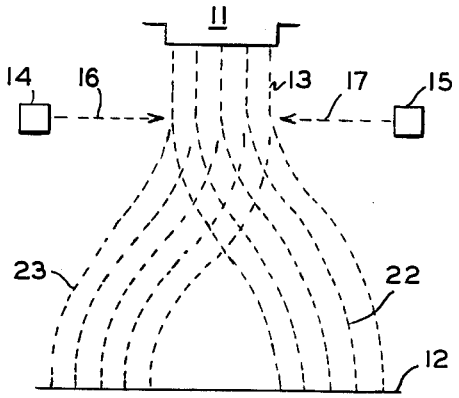
FIG. 2
FIG. 3
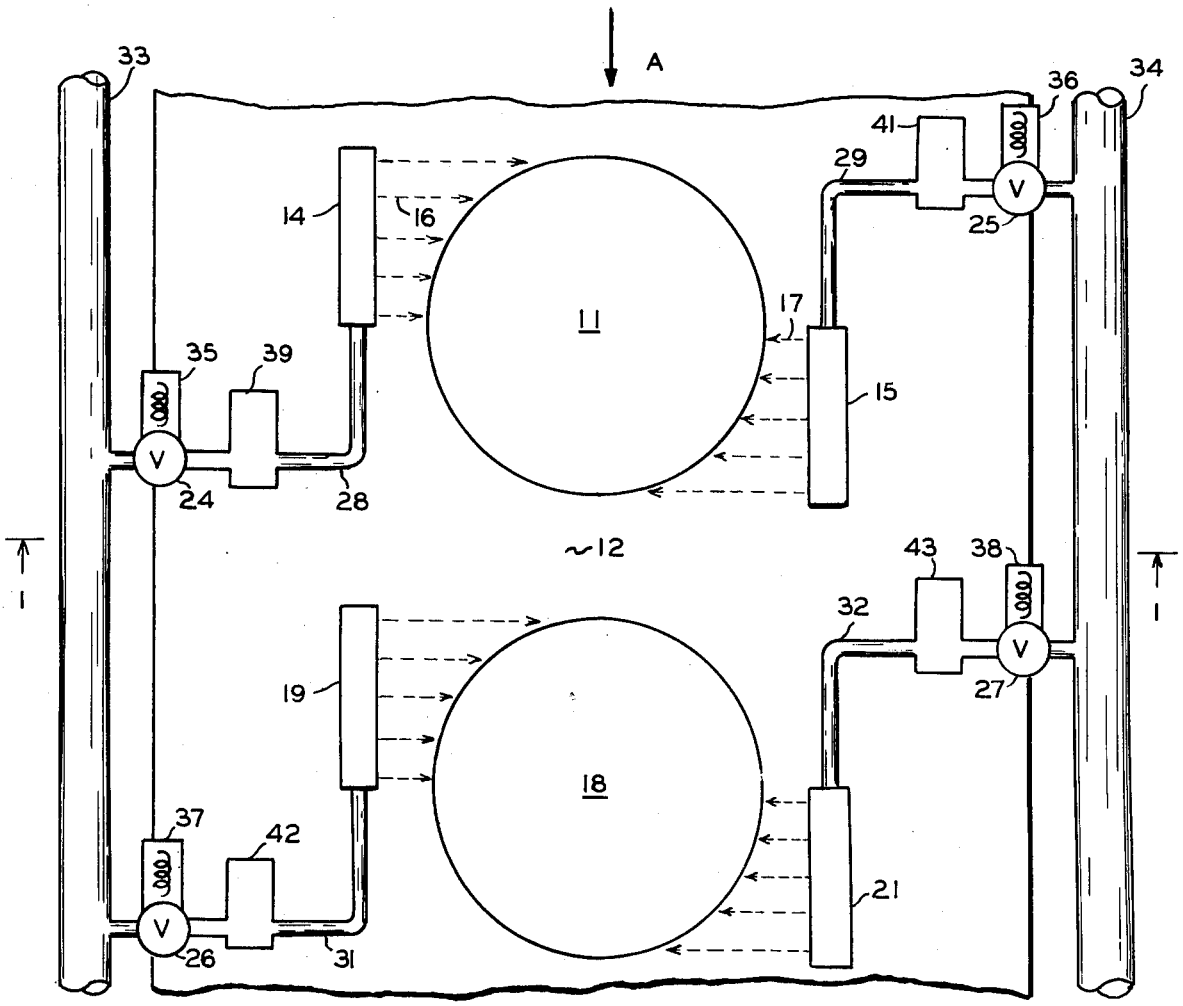

METHOD OF AND APPARATUS FOR CONTROLLING THE DISTRIBUTION OF FIBERS ON A RECEIVING SURFACE

This is a continuation, of application Ser. No. 582,464, filed May 30, 1975 now abandoned.

BACKGROUND OF THE INVENTION

1. Field of the Invention

This invention relates to apparatus for and methods of directing fibers and more particularly to directing a gas entrained stream of fibers while it is in flight between a fiberizing unit and a collection surface.

2. Description of the Prior Art

In the process of forming mats of inorganic fibrous material it has been known to fiberize the material in a fluid stream such as a hot gas blast, a stream jet, or a stream of air which entrains the fiber in a stream of limited transverse extent, frequently of generally circular cross-section, which has been termed a "veil." Fiber in the veil has been directed on a moving collector screen which can have a suction box at a few inches of vacuum on its opposite face to enhance the fiber deposition. Where collector screen velocity through the collection region is low enough, the fiber veil is such as to permit fiber dispersion over the collection region, and/or a sufficient vacuum is drawn, fibers will be distributed over the collector by the gas flow to the paths of lower flow resistance presented by the thinner regions of the mat of fibers being developed on the collector screen. At higher speeds of production and/or with more concentrated fiber veils the fibers tended to build to a great extent on a localized region of the collector screen; for example, with the veil directed to the screen center viewed in the direction of travel there was a tendency to concentrate fiber in the center of the mat being formed with a thinner or lighter weight deposition of fiber toward the longitudinal edges when so viewed.

In order to enhance fiber distribution, it was proposed in Snow et al. U.S. Pat. No. 2,863,493 of Dec. 9, 1958 entitled "Method and Apparatus of Forming and Processing Fibers" that nozzles be located on opposite sides of the region through which a veil of fibers is passed from a fiberizer to a collector screen and that a blast of air be applied alternately from the opposed nozzles to shift the veil in the collection chamber transverse of the path of advance of the collection screen. The alternate air blasts were controlled by a rotary valve mechanism having a barrel which was driven in rotation by a worm and gear from a motor to couple a source of air under pressure alternately to conduits extending to the opposed nozzles.

Another fiber manipulating arrangement is disclosed in Stalego et al. U.S. Pat. No. 2,897,874 of Aug. 4, 1959 entitled "Method and Apparatus of Forming, Processing and Assembling Fibers" wherein the generally circular cross-sectional veil of fibers from a fiberizer is formed into a loose planar web during its flight toward a collecting screen and is lapped back and forth across the width of the screen in the direction of advance of the screen by arrays of nozzles supplied with compressed air. Opposed arrays of nozzles are provided on each side of the flattened web or veil and transverse thereof over its full width so that a two-way motor driven valve control can shift the blast from one array to the other alternately.

Berthon et al. U.S. Pat. No. 3,020,585 of Feb. 13, 1962 for "Process and Apparatus for the Manufacture of Fiber Linings or Mats" employs continuous jets of air or gas to flatten a vortex or veil of fibers to a sheet form while in flight to a collecting screen surface. In some embodiments disclosed by Berthon et al. one or more nozzles are moved along regular paths in a cyclic manner by mechanical drives to change the attitude of their jet or jets with respect to the veil of fibers.

None of the methods or apparatus of the above-mentioned discloses lent themselves to variation of the control of the fiber direction without modification of the mechanical elements.

An object of the present invention is to enhance the control of the direction of a stream of fibers entrained in a fluid stream.

Another object is to enable adjustment of the control of the direction of a stream of fibers.

A further object is to control adjustably the frequency of gaseous jet pulsations applied in the directing of a stream of fibers in flight.

A fourth object is to control adjustably the interval a gaseous jet is imposed on a stream of fibers in flight to control their direction. In this regard independence between interval adjustment and frequency adjustment is desirable to control weight distribution of fibers on a collector surface.

A fifth object is to actuate valving electrically and develop control signals electrically to enhance flexibility of control both in set up of a system and during operation of the system.

SUMMARY OF THE INVENTION

In accordance with the above one feature of this invention resides in controlling one or more rapid response fluid valves in respective conduits from a source of fluid under pressure to one or more nozzles directing the fluid toward a region through which a veil of fiber is adapted to pass in its flight toward a fiber collector surface. A pulse signal generator having independent variable frequency control and independent variable duty cycle control develops the control signal for the fluid valves. In one embodiment the signal generator produces electrical signals and the valves are solenoid controlled in response to those signals.

An advantageous arrangement of nozzles to which the controls are applied includes a plurality of fiberizing units aligned in the direction of motion of a collecting screen for the fibers. Each unit has prepared nozzles on opposite sides of the usual path of flight of the fiber veil from that unit, which typically are centered in a plane normal to the axis along which the veil is advanced and are offset with respect to each other such that the simultaneous fluid burst of each nozzle resin impingement with the veil, splits the veil into two divergent and oppositely directed fiber flows. The respective fiber flows subject to the blasts are directed toward the side of the opposite nozzle. When the nozzles are oriented so that their fluid streams are in planes generally perpendicular to a plane passing through the longitudinal axis of the fiber collecting surface, the simultaneous application of bursts of fluid displaces the fiber flow subject to each blast toward the side edges of the collecting surface. In the absence of the blast the preponderance of the fiber impinges upon and is collected in the central region of the collecting surface.

Individual controls are provided for each solenoid controlled valve pair to enable the control of the valves to be separated from the primary controller. Suitable visible indicators alert the machine attendant as to those nozzle pairs which are responsive to the primary controller.

BRIEF DESCRIPTION OF THE DRAWINGS

FIG. 1 is an end elevational diagrammatic view of a fiberizer, fiber collecting surface and nozzle arrangement taken along the line 1—1 of FIG. 3;

FIG. 2 is a view as in FIG. 1 showing the effect on the flow of fibers of fluid blast from the nozzles;

FIG. 3 is a fragmentary diagrammatic plan view of two fiberizing units, their respective nozzle arrangements and an underlying collector surface.

DESCRIPTION OF THE PREFERRED EMBODIMENT

Figure 4:
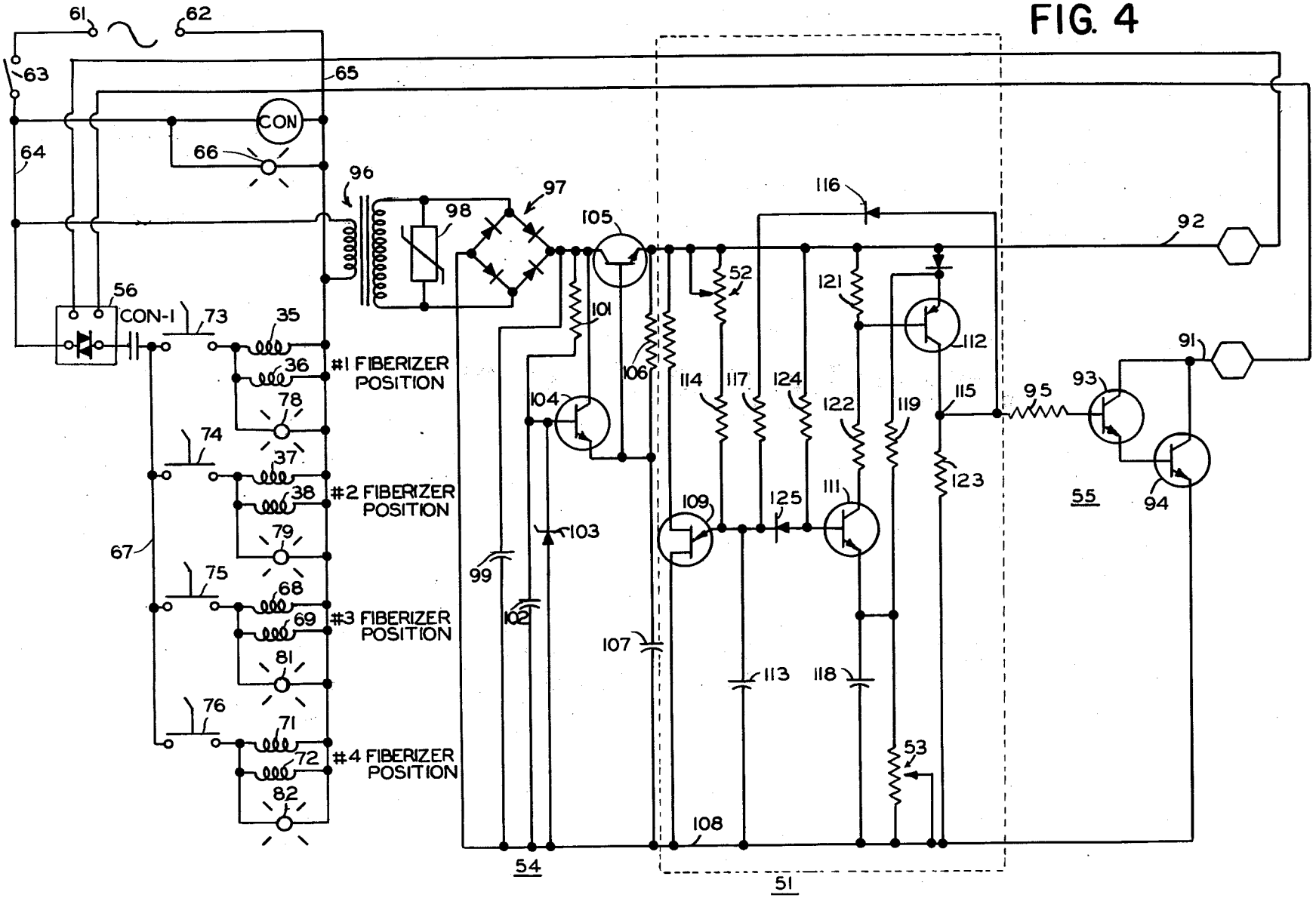
FIG. 4 is an electrical circuit diagram of one form of control for the fluid blasts issuing from the nozzles of FIGS. 1 through 3.

The distribution of fiber issuing from a fiberizing unit 11 is illustrated in FIGS. 1 and 2 wherein the unit can be of the type which generate primary fibers as by extruding them under centrifugal force from within an annulus having a perforated lip driven in rotation at high speed (not shown). In the case of glass fiber production such fiberizers have molten glass introduced within the lip and have gas blasts generally normal to the plane of rotation of the primary fiber former and directed toward a collection surface 12 to attenuate the fibers and entrain them toward the surface as a generally circular cross-section veil 13. In practice the fiberizer unit 11 thus develops a relatively well defined veil of fibers 13 which can be confined within a forming chamber (not shown) having sides and end walls extending to a foraminate collecting surface 12 to which the fibers are drawn by means of a suction on the opposite side of that surface from the unit 11. Frequently a suction box is positioned against the underside of a substantially horizontal, continuous screen, fiber receiving surface 12 and a plurality of fiberizing units are mounted above the screen with an orientation to direct their fiber veils toward the screen. Such endless screens are trained over turning rollers (not shown) which are driven to cause the screen 12 to advance in the direction of the arrow A of FIG. 3.

The suction imposed beneath the screen 12 together with the dispersion of the gas stream from the fiberizing unit 11 has been relied upon in the past to distribute the fiber veil 13 over the fiber receiving surface of the screen. This resulted in a tendency to deposit a greater weight distribution on the screen center. A more uniform weight distribution has been achieved in the past by mounting a shroud of generally hour glass configuration around the fiber veil with its longitudinal axis coincident with that of the fiber veil and oscillating the shroud around an axis normal to the longitudinal axis and in a plane normal to the direction of advance of the fiber receiving surface. Such shrouds have been know as "lapper" since their function has been characterized as laying down a series of overlapping layers of fiber transverse of the direction of advance of the fiber collecting screen.

The present invention controls fluid blasts to split the fiber veil 13 into separate fiber flows in the region through which it passes in its flight from the fiberizing unit 11 to the fiber collecting screen surface 12. One convenient fluid is air. In this context the system for developing the air blast for fiber flow direction can be considered as "air lapper." It has been found that the intermittent application of bursts of air streams directed with a component of force transverse of the path of flow of the veil of fibers and against the veil in a direction toward a plane including the direction of advance of the fiber collecting screen, effectively displaces the fiber flow. Such an air lapper system offers the advantage of avoiding or minimizing mechanical elements located within the region through which the veil of fibers and entraining hot gases flow thereby reducing the initial expense, and maintenance expense of the equipment performing the lapper function. In addition greater control and more uniform fiber distribution can be achieved with air lappers.

The air lapper system illustrated comprises an array of nozzles 14 and 15 for a fiber veil 13 arranged to direct bursts of air 16 and 17 (as shown in FIGS. 2 and 3) from opposite sides of the veil so that they split the veil into separate fiber flows and displace the flows, typically without interfering with each other. Various forms of nozzles can be employed such as elongate slits or a plurality of orifices aligned along the length of the nozzle body so that the air issues in a relatively flat array of stream lines which are in planes normal to the plane defined by the flow or longitudinal axis of the veil and the advance or longitudinal axis of the collector screen 12. In the case of a circular veil as represented in FIG. 3 the flat stream bursts can be on opposite sides of the veil 13 as represented by the stream lines 16 and 17 respectively eminating from nozzles 14 and 15. In one arrangement a veil of about 12 inches diameter has opposed nozzles which issue bursts about 4 inches wide and which are spaced to provide a gap of about 1 inch between their oppositely flowing, proximate effective edges.

The bursts of air are issued simultaneously from respective nozzle pairs and where a plurality of fiberizing units are employed, as units 11 and 18 of FIG. 3, those units subject to air lapper fiber distribution can be simultaneously activated, as by means of nozzles 14 and 15 and 19 and 21 of FIG. 3. As shown in FIG. 2, when the air bursts are imposed, each fiber veil is split and displaced as fiber flows 22 and 23 by opposing air bursts 16 and 17. When the nozzles are centered with respect to the diameter of the veil transverse of the direction of advance of the fiber collection screen, essentially one-half of the fibers of each veil is displaced from the center region toward the side of the fiber collecting screen 12 opposite that on which the nozzle source of the burst is mounted. Thus the total veil is split simultaneously by bursts of pressurized air into fiber flows 22 and 23.

Bursts of pressurized air are released by the opening and closing of rapid response air valves 24, 25, 26 and 27 in conduits 28, 29, 31 and 32 extending from sources 33 and 34 of pressurized air in the form of common air headers for each side of the fiber forming region. One form of actuator for the opening and closing of the air valves is a solenoid as represented at 35, 36, 37 and 38 of FIGS. 3 and 4 for the air valves 24, 25, 26 and 27.

In order to effectively distribute the fibers it has been found desirable to permit them to flow along the path developed by the fiberizing unit or units, as the case may be, as augmented by the suction behind the fiber collecting screen 12 surface and to periodically displace the fiber veil toward the edges of the screen 12. An advantageous control technique is to apply the air bursts in regular cycles the frequency of which is dependent on factors of fiber and veil characteristics and speed of movement of the collecting screen 12. In general the greater the speed of screen 12 the greater the frequency of the air bursts required to achieve uniform fiber distribution.

Since fiber veil splitting causes fiber impingement on collection screen 12 edges, the greater the duration of the air burst the greater the amount of fiber that is collected on the edges in the formation of the fiber mat on the collection screen. This will be appreciated from the exaggerated illustrative diagram of FIG. 2 which shows an area void of fiber deposition on the longitudinal center of the collection screen 12. In practice some fibers continue to collect in the central region, although relatively fewer fibers are allowed to accumulate in the mat formed in that region while the air bursts are imposed. Conversely, the shorter the interval of time the air burst is imposed the smaller the weight distribution of fibers toward the longitudinal edges of the fiber mat being formed on the fiber collecting screen and the greater the weight density of fibers which will collect in the center of the forming chaim 12. A control of air burst cycle frequency and duration in a period of that frequency is provided whereby each is independently adjustable.

It has been found that frequencies of up to about three cycles per second provide the desired fiber distribution at current collector screen speeds where the duty cycle, the percentage of the period the solenoids of the valves are energized, is 50 percent, and where the air pressure is about 50 p.s.i. at the headers or manifolds 33 and 34. A gradual buildup and decline of air pressure at the nozzles and thus a gradual increase and decrease of the forces imposed on the fiber veil by the air bursts is desirable to produce a uniform distribution of fibers on the fiber collecting screen. Sudden or steep pressure wave front bursts tend to disrupt the veil and cause the fiber deposits to be discontinuous. This is to be avoided where uniform weight density of fiber across the mat being produced is desired. In order to enhance this buildup and decline of pressure at the nozzles while employing fast response solenoid actuated valves, accumulators 39, 41, 42 and 43 are provided downstream of the valves, i.e. between the valves and the nozzles. The combination of the valve response and the delays in pressure buildup introduced by the accumulators impose constraints on frequency of burst cycles and duration of the bursts.

A pulse generator having independently adjustable frequency and duty cycle can be employed to control switches to the air valve solenoids 35, 36, 37 and 38 and thus the air burst frequency and duration applied to the fiber veils. An electrical pulse generator 51 is shown in FIG. 4 including adjustable potentiometer 52 for frequency control and an adjustable potentiometer 53 for duty cycle (ratio of pulse "on" duration to total frequency cycle) control. When these potentiometers have integral readout means such as a dial pointer and a scale graduated in cycles per second and ratio or percentage respectively (not shown), mounted on an operator control panel (not shown), the operator can readily control and adjust the lap speed and center to edge weight distribution of the fibers in the mat being formed.

The control generally involves a voltage regulated and current limited power supply section 54, the pulse generator 51, an amplifier section 55, and switch 56 responsive to the amplified pulses to apply line alternating current to the valve solenoids typified by solenoids 35, 36, 37 and 38. More particularly, power such as 120 volts a-c is applied at input terminals 61 and 62 through control switch 63 to buses 64 and 65. A control relay CON is connected across the busses 64 and 65 to be energized with indicator lamp 66 when master control switch 63 is closed whereby contacts CON-1 are closed to render the switching function of triac switch 56 effective through bus 67 for control of the fiberizer valve solenoids illustrated for four fiberizer positions of the glass fiber mat producing system. The main bus 65 is coupled to the parallel connected solenoids for each fiberizer position as typified by solenoids of FIG. 3 representing, as viewed in the collection screen direction of advance, right-side valve control at solenoids 35 and 37 and left-side valve control at solenoids 36 and 38 for fiberizer units 11 and 18 of fiberizer positions #1 and #2. Similar right-side and left-side nozzles for fiberizer positions #3 and #4 are controlled valve solenoids 68 and 69 and 71 and 72 respectively. The parallel connection of each fiberizer position solenoid pair behind a selector switch 73, 74, 75 and 76 insures that the valves for each side of each position operate simultaneously. An operator is kept informed of the state of operation, "on" or "off," of the air lapper for each fiberizer position by an indicator lamp 78, 79, 81 and 82 connected in parallel with the solenoids and behind the respective control switches. For operator convenience, the indicators 78–82 and control switches 73–76 for individual fiberizer positions can be located on the control panel with master switch 63, master indicator 66 and frequency control 52 and duty cycle control 53.

Switch 56 is controlled from leads 91 and 92 which are the output of a common emitter Darlington configuration of NPN transistors 93 and 94 which with input resistor 95 constitute the amplifier section 55 for pulse signals issued by pulse generator 51. A negative going pulse on lead 91 couples buses 64 and 67 through switch 56 for the duration of that pulse. An essentially step leading and trailing edge pulse is applied to resistor 95 for the amplifier input and a similar output is issued on lead 91.

The pulse control is activated by closure of master switch 63 to apply 120 volt a.c. to the primary of transformer 96 supplying from its secondary the full wave bridge rectifier 97 across the input of which is a metal oxide varistor 98. Smoothing capacitor 99, having in parallel therewith the resistance 101 and capacitor 102 and zener diode 103 at the base of transistor 104 provide a smooth voltage regulated power source. Current is regulated by transistor 105 and resistor-capacitor network 106, 107. Thus a smooth, voltage and current regulated power supply is provided to input buses 92 and 108 for the pulse generator 51 and amplifier 55 with bus 92 at 15 volts positive with respect to bus 108.

Pulse generator 51 provides independent adjustment of the frequency and duty ratio of the rectangular wave it issues. The unijunction transistor 109 is used in a sawtooth generator and transistors 111 and 112 serve to provide a positive going output when the voltage at the emitter of the unijunction transistor exceeds the voltage at the emitter of transistor 111 as determined by the setting of ratio potentiometer 53. The frequency is adjustable as a function of the resistance and capacitance values which determine the charge rate of capacitor 113 to the turn on voltage of transistor 111 and the peak point voltage of the unijunction. Potentiometer 52 is of one hundred thousand ohms and resistor 114 is of 5,000 ohms, while capacitance 113 is of 10 microfarads to provide a frequency range of 0.1 to 20 cycles per second as determined by the potentiometer setting. Independence of the frequency setting from the ratio setting is achieved by compensating the loading of the sawtooth by the transistors by feeding a current from the output terminal 115 through diode 116 and resistor 117 to the emitter of the unijunction which is equal to the current diverted into the base of NPN transistor 111 at the switching point.

The ratio circuit can be varied from 0 to 100% and the rise and fall times of the output waveform are approximately 1/500 of the period of oscillation and thus more than adequate for the response of the solenoid operated valves. The duty ratio or "on time" duration of each pulse is determined by the resistance-capacitance charge-discharge characteristics of capacitor 118, resistor 119 and the setting of ratio potentiometer 53.

In operation pulses are issued to the amplifier section 55 while transistor 112 is conductive. Transistor 112 is conductive while transistor 111 is conductive. Transistor 111 enters conduction during the charging of capacitor 113 and terminates conduction when the peak point voltage of unijunction 109 is developed across capacitor 113. As capacitor 113 charges, a voltage is imposed on the base of transistor 111 which is sufficient to forward bias the base-emitter junction into conduction. This voltage is determined by the setting of ratio potentiometer 53 assuming the charging time of capacitor 118 has been sufficient. Capacitor 118 is of a relatively low value to permit charging in a negligable time. When transistor 111 conducts the drop across resistor 121 in the voltage divider of resistors 121 and 122 imposes a voltage on the base of transistor 112 which forward biases the emitter-base junction and places the transistor in conduction so that the drop across resistor 123 is the output signal. This signal is sustained until the unijunction 109 enters conduction as the charge on capacitor 113 reaches the peak point voltage to reduce the base of transistor 111 to the reference potential of bus 108. At this time a new cycle of the sawtooth generator is initiated and the pulse generator cycle repeats.

Resistor 124 provides base bias for transistor 111 and diode 125 protects the emitter-base junction from the current from potentiometer 52 and resistor 114.

The proportion of the pulse generator cycle that the output pulse is issued is increased by decreasing the effective resistance of potentiometer 53. Conversely a decrease in the ratio is realized by increasing the resistance of potentiometer 53. The effective frequency of the pulse generator is an inverse function of the effective resistance provided by potentiometer 52. These frequency and ratio adjustments are independent so that they can be utilized by the operator to fine tune the fiber distribution of the air lapper system. Thus where the frequency of the lapper is adequate for the collector screen speed and fiber density per unit length desired and the transverse distribution of fiber is uneven, an increased ratio setting will increase the fiber weight directed to the edges and thereby decrease the weight in the mat center. Decreasing the ratio setting will increase the weight in the center and decrease it along the longitudinal edges of the mat.

The frequency control is used to avoid voids in the mat. Generally, it is set higher for higher collector screen speeds and lower for lower screen speeds.

The control for the frequency and ratio of fluid bursts disclosed herein as accomplished electronically by solid-state components can be realized by tube controls. Fluidic controls can also be arranged to provide signals for control of the valves. Valve actuation can be other than electromagnetic as by pneumatic or hydraulic actuators to release fluid under pressure from a source to a fluid projecting means which projects the fluids into the region through which the fibers are directed in flight between two spaced operating stations such as a fiberizing unit and collecting screen.

Pulse frequency and duration control can be applied to control fluid projecting means applied to other than the fibers issuing from plural fiberizing units as to the fiber from an individual fiberizer. It can also be applied with advantage to systems having nozzles located other than on opposite sides of a fiber veil as to nozzles on a single side of the veil. Alternate bursts from nozzle sets for a fiberizer unit or other means of inducing the flight of fibers in space can be controlled by the present system employing a pulse generator or plural pulse generators which can be synchronized.

In view of the variations in the nature of the pulse generator and utilization of the pulse control mechanisms wherein independent frequency and ratio control is afforded, it is to be appreciated that the above disclosure is to be read as illustrative and not in a limiting sense.

What I claim is:

1. Apparatus for directing fibers during their flight in a region between two spaced operating stations comprising means for providing gas under pressure; means for projecting gas from said providing means into said region; a pulse signal generator for cyclically issuing signal pulses; adjustable control means for said pulse generator for controlling the frequency of the pulse signal cycle; adjustable control means for said pulse generator for adjustably controlling the duration of the pulse during each cycle; solenoid actuated valve means for controlling the flow of gas from said gas providing means to said projecting means; and control means responsive to signal pulses from said generator for cyclically issuing electrical signals to operate said solenoid for controlling said valve means.

2. The method of directing fibers during their flight through a region between two spaced operating stations comprising the steps of cyclically applying bursts of gas directed into said region with a component of force transverse of the flight of the fibers; generating electrical pulse signals in repetitive cycles to control the bursts of gas; adjusting the frequency of the electrical pulse signal cycles to adjust the cyclic frequency of the bursts of gas; and adjusting the ratio of the time interval within the period of a cycle that the electrical signal is at one signal level to the time interval within the period of a cycle that the electrical signal is at a second signal level to adjust the ratio of the time interval within the period of a gas burst cycle that the gas burst is applied to the time interval within the period of a gas burst cycle that the gas burst is not applied.

3. In apparatus for forming glass fibers wherein said fibers are projected as a hollow tubular formation from the forming means toward a collecting surface, said formation being distributed upon the collecting surface through the interaction of said veil and intersecting on-off pulsating jets of gas the improvement comprising adjustable control means for independently controlling the cycle frequency and the ratio of the on to off periods during a cycle.

4. Apparatus for processing mineral fibers comprising a centrifuge, means for supplying heat softened mineral material to the centrifuge, means for rotating the centrifuge to project streams of the heat softened mineral material from orifices in the centrifuge wall by centrifugal forces, means for attenuating the heat softened mineral material streams into fibers and conveying said fibers axially away from the centrifuging means as a hollow tubular veil of fibers towards a collection surface, nozzle means disposed between said centrifuge and collection surface adjacent the veil of fibers for projecting intermittent gaseous blasts toward the veil of fibers to distribute the fibers upon the collection surface, control means for separately controlling the frequency of said intermittent gaseous blasts and the duration of the blast during each cycle.

5. The apparatus of claim 4 wherein the nozzle means comprises a pair of diametrically opposed nozzles positioned external to the fiber veil.

6. The apparatus of claim 5 wherein said opposed nozzles are diametrically offset one to the other.

7. Apparatus for directing wool glass fibers during their flight through regions from a plurality of rotary fiberizing units to a fiber collecting surface comprising means for providing gas under pressure; means associated with each of a plurality of said fiberizing units for projecting gas from said gas providing means into the respective region intermediate said unit and said collecting surface through which said fiber passes in flight to said collecting surface associated with said fiberizing unit; an electronic pulse signal generator having separate independently adjustable controls for controlling the frequency of cyclically issued signal pulses and the duration of said signal pulses; valve means individual to each gas projecting means for controlling the flow of gas from said gas providing means to said respective projecting means; and electrical control means for each of a plurality of said valve means responsive to electrical signal pulses from said signal generator for controlling said valve means.

8. Apparatus according to claim 1 wherein said gas providing means is a means for providing compressed air.

9. Apparatus according to claim 1 wherein said gas projecting means is a plurality of nozzle means directed toward said region from first and second opposed sides of said region and wherein said valve means comprise first and second valves individual to said nozzle means of respective first and second opposed sides.

10. Apparatus according to claim 9 wherein each of said valves is solenoid actuated by electrically parallel connected solenoids for simultaneously controlling gas bursts from said first and second nozzle means.

11. Apparatus for distributing a veil of fibers during their deposition on a collecting surface comprising means for developing a veil of fibers directed through a region toward said collecting surface; a gas nozzle directed toward the region through which the veil is adapted to pass; means for issuing gas bursts from said nozzle; first adjustable control means for adjustably controlling the frequency of issuance of gas bursts from said nozzle; and second adjustable control means for adjustably controlling the duration of the issuance of fluid bursts from said nozzles.

12. Apparatus according to claim 11 wherein said means for issuing gas bursts from said nozzles includes means for providing gas under pressure; a conduit from said source to said nozzle; and a valve for said gas in said conduit.

13. Apparatus according to claim 12 wherein said valve is controlled by said first and second adjustable control means.

14. Apparatus according to claim 11 wherein said first and second adjustable control means are electrical signal control means.

15. Apparatus according to claim 14 wherein said electrical signal control means is a pulse generator having an adjustable frequency and an adjustable duty cycle, and a switching means responsive to the pulse frequency and pulse duration from said pulse generator.

16. Apparatus according to claim 15 wherein said means for issuing gas from said nozzles includes means for providing gas under pressure, a conduit from said source to said nozzle, and a solenoid valve for said gas in said conduit; and wherein said switching means applies electrical power to said solenoid valve.

17. Apparatus according to claim 11 including individual manually adjustable controllers for said respective first and second adjustable control means.

18. Apparatus according to claim 11 including a plurality of means for developing individual veils of fibers; a plurality of nozzles each being directed toward the region through which a respective veil is adapted to pass; means responsive to said frequency and said duration control means for issuing gas bursts from a plurality of said nozzles simultneously.

19. Apparatus according to claim 18 including means for selectively inhibiting the issuance of gas from a nozzle.

20. Apparatus according to claim 19 including indicator means for indicating the operating state of respective nozzles.

21. Apparatus according to claim 20 including means for selectively enabling and disabling said valve means individual to respective gas projecting means.

* * * * *